United States Patent [19]

Erickson

[11] 4,332,521

[45] Jun. 1, 1982

[54] HIGH SPEED JET ROTATING CASING APPARATUS

[75] Inventor: John W. Erickson, Huntington Beach, Calif.

[73] Assignee: Kobe, Inc., City of Commerce, Calif.

[21] Appl. No.: 120,188

[22] Filed: Feb. 11, 1980

[51] Int. Cl.[3] ..... F04D 1/12

[52] U.S. Cl. ..... 415/189

[58] Field of Search ..... 415/88, 89

[56] References Cited

U.S. PATENT DOCUMENTS

| | | | |
|---|---|---|---|
| 1,945,759 | 2/1934 | Sim | 415/89 |
| 3,180,268 | 4/1965 | Willis et al. | 415/89 |
| 3,339,639 | 9/1967 | Elmes et al. | 415/89 |
| 3,742,713 | 7/1973 | Schweitzer | 415/89 |

FOREIGN PATENT DOCUMENTS

| | | | |
|---|---|---|---|
| 230159 | 11/1963 | Austria | 415/89 |

*Primary Examiner*—Louis J. Casaregola

*Attorney, Agent, or Firm*—William C. Norvell, Jr.

[57] ABSTRACT

A fluid compressor of the pitot type includes a high speed, high stress rotary casing. The casing is formed from a pair of tapered discs spaced apart and mounted for rotation about an axis. The discs form the end walls of the casing. A side wall is connected between the opposed peripheral portions of the discs to enclose the casing and a stationary pitot tube. The side wall is formed from a pair of concentric rings connected by a plurality of beams. In one embodiment, the beams are C-shaped with an upper leg attached to the outer ring and a lower leg attached to the inner ring, the longitudinal axis of the beams being parallel to the axis of rotation. In an alternate embodiment, the rings are formed from the upper and lower legs of a plurality of I-shaped beams, the longitudinal axis of the beams being parallel to the axis of rotation.

5 Claims, 5 Drawing Figures

HIGH SPEED JET ROTATING CASING APPARATUS

BACKGROUND OF THE INVENTION

1. Field Of The Invention

The present invention relates to fluid compressors of the pitot type.

2. Description Of The Prior Art

The pitot type pump for pumping liquids is well known. Such a pump is disclosed in U.S. Pat. No. 4,045,145 issued to J. W. Erickson and V. Budrys. A stationary pitot tube is mounted inside a rotating casing or housing. Fluid is delivered to the interior of the housing through a plurality of radial ducts in the walls of the casing which discharge the fluid by centrifugal force. The stationary pitot tube collects the fluid which is rotating with the casing and the ram effect forces the fluid out through the pitot tube.

The pitot type pump can also be utilized as a gas compressor. However, such an apparatus must be operated at much higher speeds than a pitot type pump of the same size and pressurizing capacity, since a fluid such as a gas is much lower in density and compressibility than liquids. A pitot compressor with a liquid separator is disclosed in U.S. Pat. No. 4,059,364 issued to P. H. Anderson and J. W. Erickson.

The high speeds at which a pitot type compressor must operate creates a stress problem in the rotating casing. The prior art casings are constructed as an annular, cup-shaped housing mounted coaxially on a driven shaft and a cover is bolted over the open end of the housing. For the purposes of stress calculations, the casing can be thought of as two, spaced apart discs mounted on the shaft and closed at the periphery by a ring which basically is a free ring. In a typical gas well application, a pitot type compressor would require four or five stages which is impractical

SUMMARY OF THE INVENTION

The present invention relates to a pitot type gas compressor having a casing structure which is substantially stronger than the prior art rotating casings, hence capable of higher speeds of rotation. The casing according to the present invention is formed from a pair of spaced apart, tapered discs mounted on the shaft and closed at their peripheries by a beam type structure. The discs are tapered from a larger section at the shaft to a smaller section at the periphery for a relatively high centrifugal force resistance. The beam type structure can be formed from inner and outer spaced apart rings extending between the peripheral portions of the inner sides of the discs. The rings can be connected by a plurality of channel section shear elements. A plurality of bolts can extend through the discs and between the rings to hold the casing together.

Accordingly, it is an object of the present invention to provide a pitot type gas compressor having a reduced number of stages for a given pressurizing capacity.

It is another object of the present invention to provide a pitot type compressor rotating casing which can be operated at increased speeds and stress loads.

DESCRIPTION OF THE PREFERRED EMBODIMENTS

Figure 1:
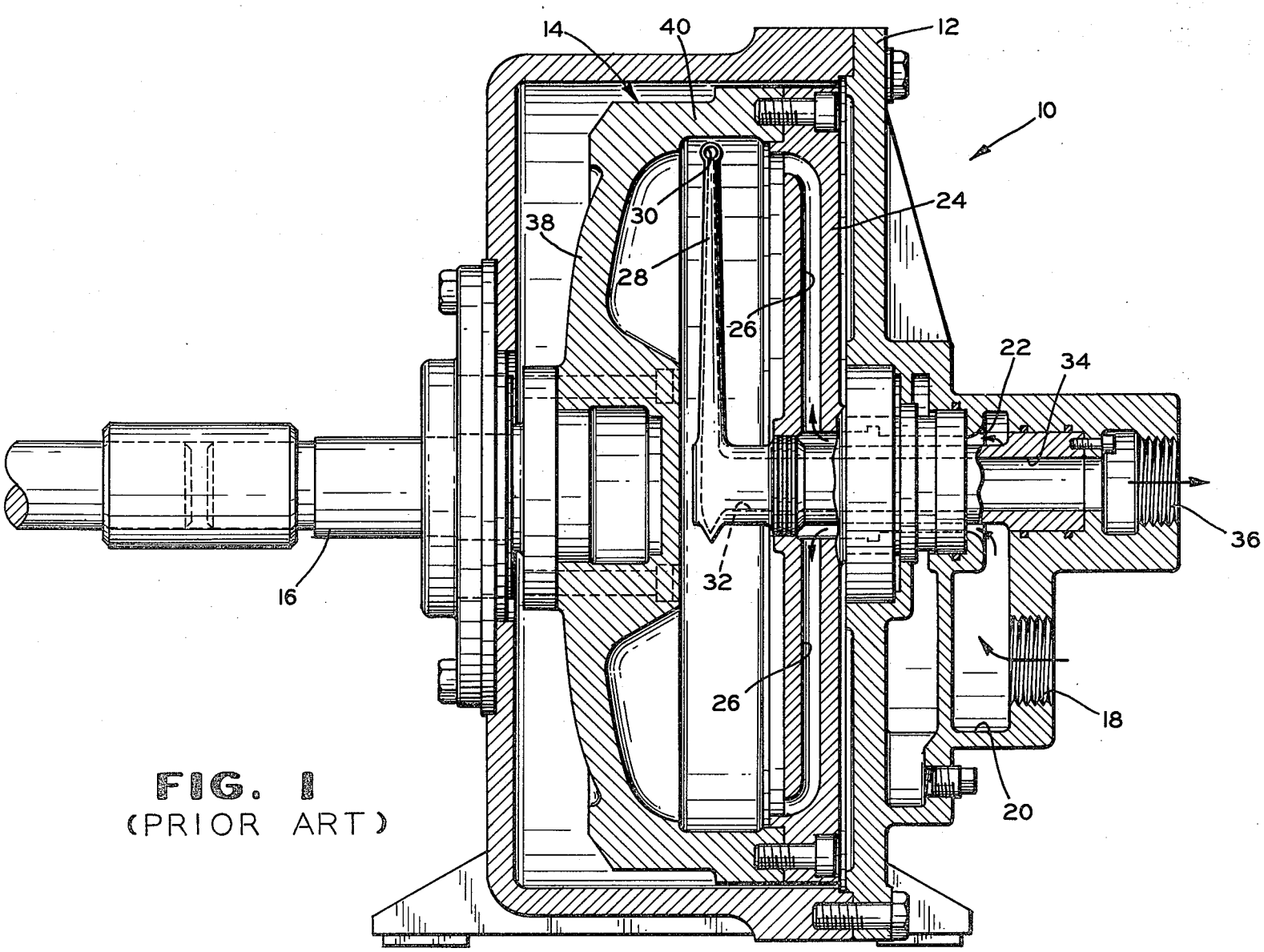
FIG. 1 (PRIOR ART)
FIG. 1 is a cross-sectional elevational view of a prior art pitot type compressor.

Referring to FIG. 1, there is shown a typical prior art pitot type compressor 10. An outer housing 12 encloses a rotary casing 14 mounted on a shaft 16. The shaft 16 extends through an end wall of the outer housing and is mounted in a bearing structure for rotation about the axis of the compressor. The shaft 16 is coupled to a suitable drive motor (not shown).

The housing 12 has an inlet 18 formed in the other end wall for connection to a source of gas to be compressed. The inlet 18 is in fluid communication with a chamber 20 leading to an annular passage 22 extending into one end wall 24 of the rotor 14. A plurality of generally radial passages 26 are formed in the end wall 24. The inner ends of the passages 26 communicate with the annular passage 22 while the outer ends are open to the interior of the rotary casing 14 at the inner periphery thereof.

Mounted in the rotary casing 14 is a stationary, radially extending hollow pitot or pickup tube 28. The pitot tube 28 has an inlet 30 formed in the outer end thereof facing in a direction opposite the direction of rotation of the rotary casing 14. The pitot tube 28 receives gas from the inner periphery of the casing 14 through the inlet 30 with a ram effect. The pitot tube 28 has an outlet 32 formed adjacent its inner end coaxial with the casing 14 and in communication with a coaxial discharge duct 34 connected to an outlet 36 formed in the housing 12.

In general, the centrifugal force generated by the rotation of the casing 14 generates a high gas pressure adjacent the inner periphery of the casing. The high pressure gas enters the inlet 30 of the pitot tube 28 with a ram effect so that it is further compressed. The gas then flows radially inwardly through the tube 28 and then axially through the outlet 32, the discharge duct 34, and the outlet 36. Although not described in detail, it is well known that the pitot tube 28 is attached to the stationary housing 12 and rotating seals are utilized at the point the discharge duct 34 extends through the rotary casing 14 and the point the rotary casing 14 is mounted in the outer housing 12.

Typically, the rotary casing 14 is formed from a cup shaped casting having an end wall 38 and an axially extending, annular side wall 40, and a cover, such as the end wall 24, suitably fastened to the side wall 40. For the purpose of stress analysis, the end walls 24 and 38 can be thought of as discs mounted on a common axis of rotation and joined at their peripheries by the side wall 40. These discs support the side wall 40 at its edges, but the center section of the side wall functions as a free ring under stress.

Figure 2:
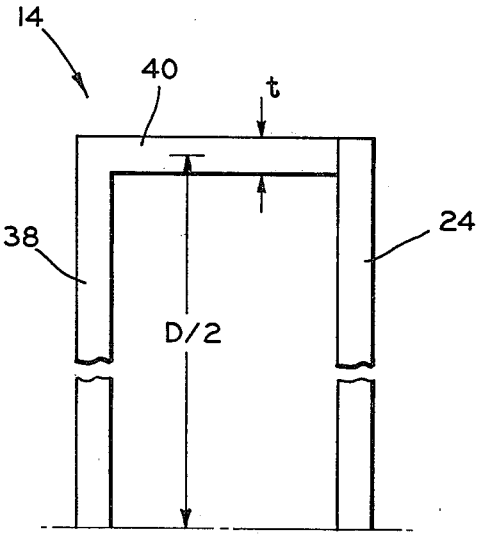
FIG. 2 (PRIOR ART)
FIG. 2 is a simplified, cross-sectional schematic of the rotary casing shown in FIG. 1.

There is shown in FIG. 2 in simplified cross-sectional schematic form, the rotary casing 14. The end wall 40 has an average thickness t and a diameter of D at its centerline, the radius from the center of rotation of the casing being shown as D/2. The stress generated in the end wall 40 is a function of the fluid pressure in the casing and the tangential stress due to the rotation of the casing.

Figure 3:
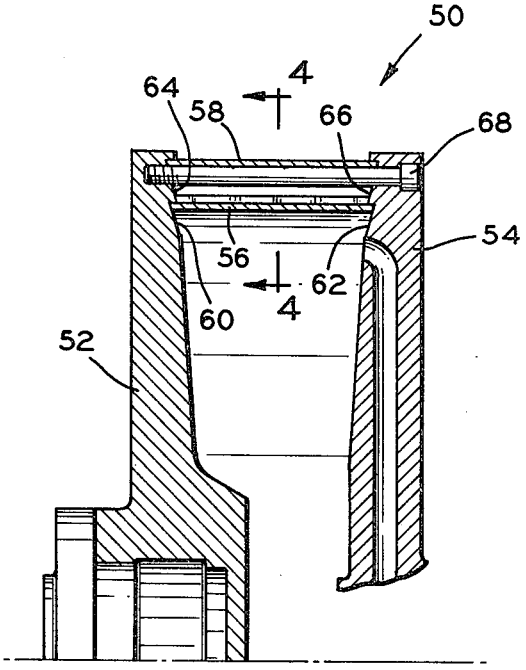
FIG. 3 is a fragmentary, quarter-sectional view of a rotary casing according to the present invention.

FIG. 3 is a fragmentary, quarter-sectional view of a rotary casing according to the present invention. The casing 50 has a first end wall 52 corresponding to the end wall 38 of FIG. 1 and a second end wall 54 corresponding to the end wall 24 of FIG. 1. However, the end walls 52 and 54 are formed as tapered discs, tapering from a wider section at the center of rotation to a narrower section at their peripheries.

A side wall of the casing 50 is formed from an inner ring 56 and an outer ring 58. The discs 52 and 54 each have a pair of annular notches formed in their opposing faces for retaining the rings. An inner pair of notches 60 and 62 retain the edges of the inner ring 56 and prevent the ring from moving radially outwardly. An outer pair of notches 64 and 66 retain the edges of the outer ring 58 and prevent the ring from moving radially outwardly. A bolt 68 extends through the disc 54 between the rings 56 and 58 and threadably engages the disc 52. The bolt 68 is representative of a plurality of such bolts spaced about the periphery of the discs 52 and 54 to connect the discs and the rings for co-rotation.

Figure 4:
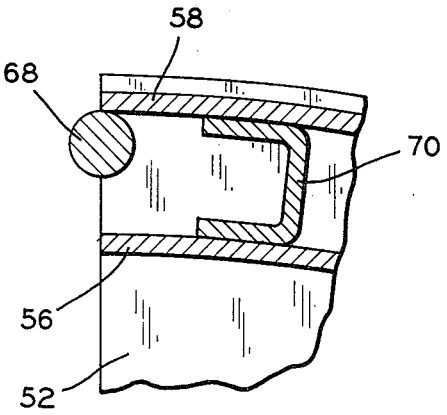
FIG. 4 is a cross-sectional view taken along the line 4—4 of FIG. 3.

FIG. 4 is a cross-sectional view taken along the line 4—4 in FIG. 3. The rings 56 and 58 are supported between the discs by a beam 70 which is representative of a plurality of such beams spaced about the periphery of the discs. The beam 70 is C-shaped in cross-section with an upper leg attached to the inner surface of the ring 58 and a lower leg attached to the outer surface of the ring 56. The legs can be attached to the rings by any suitable means such as welding.

Figure 5:
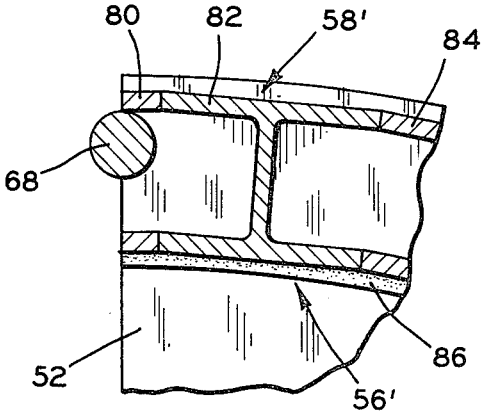
FIG. 5 is a cross-sectional view, similar to FIG. 4, of an alternate embodiment of rotary casing according to the present invention.

FIG. 5 is a cross-sectional view, similar to FIG. 4, of an alternate embodiment of the side wall of the rotary casing. The tapered disc 52 and the bolt 68 can be the same as the like numbered elements shown in FIGS. 3 and 4. An outer ring 58' and an inner ring 56' are formed from the upper and lower legs respectively of a plurality of beams which are I-shaped in cross-section. As shown in FIG. 5, a beam 82 is positioned between adjacent beams 80 and 84 to form the rings 56' and 58'. The adjacent ends of the lower legs of the beams can be sealed with a suitable material 86 to prevent leakage.

The stresses generated in the described side wall by the fluid pressure and the rotation of the casing can be calculated by using well-known equations. Thus, it can be shown that the side walls shown in FIGS. 3–5 can withstand a stress level approximately two and one-half times that of the side wall of the prior art rotary casing. Therefore, a compressor application which would require four or five stages of prior art rotary compressors requires only two stages utilizing rotary casings constructed according to the present invention.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In a pitot hydrodynamic device having a rotary casing mounted for rotation about an axis, a fluid supply inlet connected between the interior of the rotary casing and a source of fluid to be pressurized, a pressurized fluid discharge duct, and a pitot tube extending radially from the axis of rotation in the casing and having adjacent its outer end an inlet facing in a direction opposite to the direction of rotation of the rotary casing and in fluid communication through the pitot tube with the discharge duct, the rotary casing comprising: a plurality of spaced-apart tapered discs mounted for rotation about the axis and forming end walls of the casing; said discs tapering in cross-section to a minimum thickness at their respective peripheries; and a side wall extending between and attached to the peripheral portions of said tapered discs to enclose the pitot tube, said side wall being formed by a plurality of radially spaced concentric rings and being secured to said discs by a plurality of axially parallel bolts disposed between said concentric rings.

2. The apparatus of claim 1 including a plurality of C-shaped beams connected between said rings and positioned with their longitudinal axes parallel to the axis of rotation.

3. The apparatus of claim 1 wherein said side wall is formed of a plurality of I-shaped beams connected between said rings, an upper leg of said beams forming an outer ring and a lower leg of said beams forming an inner ring defining said side wall, said beams being positioned with their longitudinal axes parallel to the axis of rotation.

4. The apparatus of claim 3 including sealing material coating the junctures of said lower legs of said beams.

5. The apparatus of claims 1, 2, 3 or 4 wherein said tapered discs are secured to said side wall by a plurality of peripherally spaced bolts passing between said inner and outer rings.

* * * * *